US008573696B2

(12) United States Patent
Kuno

(10) Patent No.: US 8,573,696 B2
(45) Date of Patent: Nov. 5, 2013

(54) OTTOMAN DEVICE FOR VARIABLE-CUSHION-LENGTH SEAT

(75) Inventor: Satoru Kuno, Aichi-ken (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 279 days.

(21) Appl. No.: 13/152,593

(22) Filed: Jun. 3, 2011

(65) Prior Publication Data

US 2011/0298249 A1 Dec. 8, 2011

(30) Foreign Application Priority Data

Jun. 8, 2010 (JP) ..... 2010-131201

(51) Int. Cl.
*A47C 7/14* (2006.01)
*A47C 7/50* (2006.01)

(52) U.S. Cl.
USPC ..... 297/284.11; 297/423.34; 297/423.36

(58) Field of Classification Search
USPC ..... 297/284.11, 423.34, 423.36, 68, 69, 70
See application file for complete search history.

(56) References Cited

U.S. PATENT DOCUMENTS 5,560,681 A * 10/1996 Dixon et al. ..... 297/284.11
6,095,610 A * 8/2000 Okajima et al. ..... 297/423.36
6,227,489 B1 * 5/2001 Kitamoto et al. ..... 244/118.5
6,237,994 B1 * 5/2001 Bentley et al. ..... 297/118
6,974,186 B1 * 12/2005 Chang ..... 297/68
2001/0033101 A1 * 10/2001 Plant ..... 297/342
2006/0186721 A1 * 8/2006 Flory et al. ..... 297/423.36
2009/0195041 A1 * 8/2009 Ito et al. ..... 297/337

FOREIGN PATENT DOCUMENTS

JP 4324444/2005-124657 5/2005
JP 2006-43240 2/2006
JP 2009-179192 8/2009
WO 2009/098040 8/2009

OTHER PUBLICATIONS

U.S. Appl. No. 13/084,610 to Satoru Kuno, filed Apr. 12, 2011.
China Office action, dated Feb. 4, 2013 along with an english translation thereof.

* cited by examiner

*Primary Examiner* — Philip Gabler
(74) *Attorney, Agent, or Firm* — Greenblum & Bernstein, P.L.C.

(57) ABSTRACT

An ottoman device includes a first mechanism that has an operating portion operable to adjust a longitudinal position of a front end portion of a seat cushion corresponding to the inner sides of knees of a seated person, and is operable to vary a cushion length by adjusting the longitudinal position of the front end portion of the seat cushion by means of the operating portion, an ottoman body that extends from the front end portion of the seat cushion toward toes of the seated person, and a second mechanism operable to lift the ottoman body by reducing a flexion angle of the ottoman body at the front end portion of the seat cushion, so as to bring the ottoman body into a lifted condition. The ottoman body is provided as a unit with the operating portion, and the first and second mechanisms operate independently of each other.

7 Claims, 3 Drawing Sheets

OTTOMAN DEVICE FOR VARIABLE-CUSHION-LENGTH SEAT

The disclosure of Japanese Patent Application No. 2010-131201 filed on Jun. 8, 2010 including the specification, drawings and abstract is incorporated herein by reference in its entirety.

BACKGROUND OF THE INVENTION

1. Field of the Invention

The invention relates to an ottoman device for a variable-cushion-length seat, which includes a cushion-length varying mechanism and an ottoman body.

2. Description of the Related Art

In Japanese Patent No. 4324444, an ottoman device is disclosed which is improved in view of differences in height among seated persons so that a distal end portion of an ottoman body is prevented from pushing a lower part of the calf of a seated person when the ottoman body is lifted, even if the legs of the seated person are long. More specifically, the ottoman body is connected to a seat cushion via link members at the front of the seat cushion, and the ottoman body is lifted in a condition where the ottoman body is extended frontward by a given length by means of the link members. Accordingly, the ottoman device, which is comfortable for a particular type of people having long legs, is provided.

SUMMARY OF THE INVENTION

However, even when a person having short legs is seated, the link members are similarly extended forward by a given length when the ottoman body is lifted; therefore, the below-knee region of the seated person may be forced to be pulled forward. The invention provide an ottoman device which is comfortable irrespective of differences in height among seated persons, wherein an ottoman body is lifted at a position where the cushion length is adjusted as desired.

A first aspect of the invention is concerned with an ottoman device for a variable-cushion-length seat, which includes: a cushion-length varying mechanism that has an operating portion operable to adjust a longitudinal position of a front end portion of a seat cushion corresponding to the inner sides of knees of a seated person, and is operable to vary a cushion length by adjusting the longitudinal position of the front end portion of the seat cushion by means of the operating portion, an ottoman body that extends from the front end portion of the seat cushion toward toes of the seated person, and an ottoman operating mechanism operable to lift the ottoman body by reducing a flexion angle of the ottoman body at the front end portion of the seat cushion, so as to bring the ottoman body into a lifted condition. In the ottoman device, the ottoman body is provided as a unit with the operating portion of the cushion-length varying mechanism, and the cushion-length varying mechanism and the ottoman operating mechanism operate independently of each other.

BRIEF DESCRIPTION OF THE DRAWINGS

The foregoing and further objects, features and advantages of the invention will become apparent from the following description of exemplary embodiments with reference to the accompanying drawings, wherein like numerals are used to represent like elements and wherein.

DETAILED DESCRIPTION OF EMBODIMENTS

Figure 1:
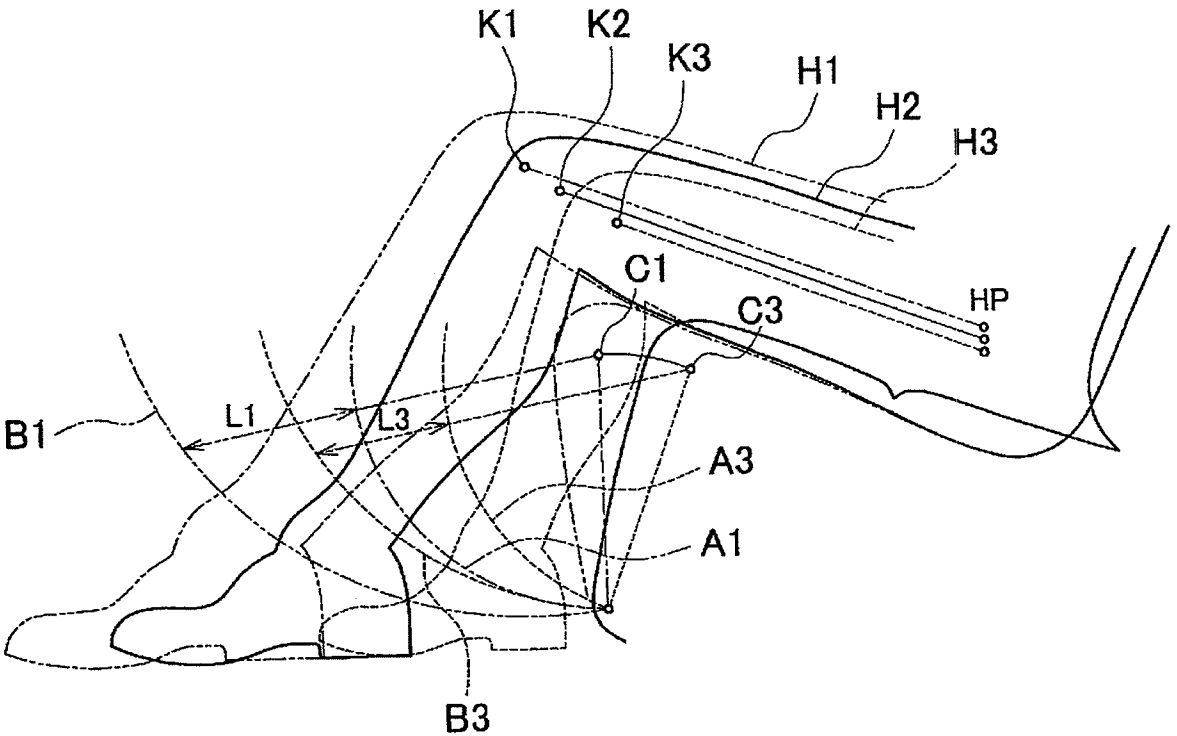
FIG. 1 is a side view of an ottoman device, which is useful for explaining the summary of one embodiment of the invention.

FIG. 1 explains the manner of dealing with differences in height among seated persons according to one embodiment of the invention. Where a seated person changes from a tall person H1, a middle-height person H2, to a short person H3, the position of the knee joint of the person when seated varies from K1, K2 to K3. Therefore, the cushion length of the seat cushion is varied according to the position of the knee joint, in order to provide seating comfort. In FIG. 1, HP indicates the hip point of each seated person.

In FIG. 1, C1 denotes a pivot point about which an ottoman body swings when the cushion is positioned to provide the largest cushion length suitable for the tall person H1, and C3 denotes a pivot point about which the ottoman body swings when the cushion is positioned to provide the smallest cushion length suitable for the short person H3. When the ottoman body is operated to swing about each pivot point C1, C3, the distal end of the ottoman body travels along a movement locus, which is denoted by A1, A3, respectively. In the meantime, B1, B3 denote movement loci of the ankles of the tall person H1 and short person H3, respectively, in accordance with the movement of the ottoman body. As described above, the movement locus A1, A3 of the distal end of the ottoman body is an arc whose center is located at the pivot point C1, C3, respectively, of the ottoman body, whereas the movement locus B1, B3 of the ankle of each seated person is an arc whose center is located at the position K1, K3, respectively, of the knee joint of the person. Since the centers C1, C3 of the former arcs are spaced apart from the centers K1, K3 of the latter arcs, respectively, a difference L1 between the locus A1 and the locus B1 when the ottoman body is lifted to a position where it forms the same angle with respect to the seat cushion surface becomes larger than a difference L3 between the locus A3 and the locus B3. Namely, if the below-knee length of the seated person supported by the ottoman body is set in accordance with the short person H3, the length is too short for the tall person H1. In this embodiment, therefore, the length of the ottoman body is adjusted in accordance with the cushion length; if the cushion length is set to be relatively short in accordance with the body size of the short person H3, the length of the ottoman body is also reduced in accordance with L3. To the contrary, if the cushion length is set to be relatively long in accordance with the body size of the tall person H1, the length of the ottoman body is also increased in accordance with L1. Namely, in order to be suited for the body type or physical size of a short person, the cushion length needs to be short, and the length of the ottoman body needs to be short, while the distance from the distal end of the ottoman body to its pivot point C3 needs to be reduced. Also, for a tall person, the cushion length needs to be long, and the length of the ottoman body needs to be long, while the distance from the distal end of the ottoman body to its pivot point C1 needs to be increased. In this embodiment, these requirements are satisfied.

In the following, the specific construction and operation of the above-indicated one embodiment of the invention will be described with reference to FIG. 2 and FIG. 3. In this embodiment, as well shown in FIG. 3, a surface portion 50 of the seat cushion consists of a cushion pad 53, a laminate pad 52, and a skin material 51 made of genuine leather, and the surface of the ottoman body, as well as the upper surface of the seat cushion, is covered with the surface portion 50. Therefore, the surface portion 50 is bent and stretched in accordance with the movement of the ottoman body. When the ottoman body is in a retracted condition in which the ottoman body is not lifted, the surface portion 50 is bent at an inside portion of the knee joint of the seated person, and first swing arms 11 that constitute a cushion-length varying mechanism are provided on the right-hand and left-hand sides of the seat cushion, to be located inside the bent portion of the surface portion 50.

Each of the first swing arms 11 has an upper end portion that constitutes an operating portion of the invention, and a lower end portion that is swingably connected, via a hinge shaft 42, to a bracket 41 fixed to a seat cushion frame. A second swing arm 21 that constitutes the ottoman body is connected to a front, upper end portion of the first swing arm 11, such that the second swing arm 21 is swingable about a hinge shaft 21*a*. A frame 22 and a slide member 31 are connected to the second swing arm 21, such that the slide member 31 is slidable relative to the frame 22. To this end, a slit 31*b* is formed in a side portion of the slide member 31, and a projection provided on a side portion of the frame 22 engages with the slit 31*b*. Also, the frame 22 and the slide member 31 are slidably held by a slide guard 61, and the top wall of the slide guide 61 is sandwiched between the cushion pad 53 of the surface portion 50 and an elastic seat 54 provided below the cushion pad 53, so that the slide guide 61 is immovably fixed in position. The opposite sides of the slide guide 61 are covered with the surface portion 50, and end portions 50*a* of the surface portion 50 are inserted into and fixed in grooves 61*a* formed in the lower faces of the opposite side portions of the slide guide 61. The elastic seat 54 is provided integrally with the surface portion 50 to extend over the entire lower surface of a distal end portion of the cushion pad 53, and is formed of a material having a small coefficient of friction, so that the ottoman body located on the lower surface of the elastic seat 54 and the surface portion 50 can easily move relative to each other. Also, the elastic seat 54 has elasticity so as not to hinder the movement of the ottoman.

The slide member 31 consists of right and left members 31*c* that are slidable relative to right and left frames 22, and a front member 31*d* that connects the front ends of the right and left members 31*c* to each other, and a net 32 having flexibility is extended over the upper faces of these members 31*c*, 31*d*. The distal ends of the right and left members 31*c* of the slide member 31 are bent downward, and a distal end portion of the upper surface of the slide member 31 is formed by a curved surface, so that the pressure applied from the distal end portion of the slide member 31 to the legs of the seated person does not become too high when the ottoman supports the legs of the seated person, while assuring a good appearance. About one half (at the front side) of the upper surface portion of the slide guide 61, which has the same width as that of the net 32 on the slide member 31, is cut out or removed. With the slide guide 61 thus formed, the size of the slide guide 61 that exists as a rigid body under the surface portion 50 is reduced, and the pressure or force exerted on the legs of the seated person, when they are supported on the ottoman, is reduced. Thus, the surface portion 50 is connected via the slide guide 61 to the frame 22 and slide member 31 that constitute the ottoman body, so that the surface portion 50 moves in accordance with the movement of the ottoman.

Next, the cushion-length varying mechanism and an operating mechanism for operating the ottoman body will be described. The first swing arms 11 are located at the inner sides of right and left brackets 41, and frames (not shown) that are partially joined with the brackets 41 are provided for supporting motors of respective operating mechanisms. One of the motors has an output shaft that is joined to the upper part of each first swing arm 11, so as to swing the first swing arm 11 back and forth. Here, the first swing arm 11 and one motor constitute the cushion-length varying mechanism of the invention.

The output shaft of the other motor is joined to a hinge shaft 24*a* provided at one end of a link 24, so that the other motor swings the second swing arm 21, and the hinge shaft 24*a* is pivotally supported on the first swing arm 11 located on the left-hand side of the seated person. The other end of the link 24 is pivotally joined to one end of a link 23, and the other end of the link 23 is pivotally joined to the second swing arm 21 at a position spaced from the hinge shaft 21*a*. With this arrangement, when the link 24 is rotated by the other motor, the link 24 causes the second swing arm 21 to swing about the hinge shaft 21*a*, via the link 23, so that the ottoman body can be moved between the lifted position and the retracted position. Here, the links 23, 24 and the other motor constitute the ottoman operating mechanism of the invention.

In the meantime, links 25 and 26 are pivotally joined to the frame 22 of the ottoman body and the first swing arm 11, respectively, and these links 25, 26 are pivotally joined to each other. One end of the link 26 is joined to the first swing arm 11, and the other end of the link 26 is joined to one end of the link 25. The other end of the link 25 is generally in the shape of letter "Y", or in a forked form, and a pin 31*a* provided at a proximal end portion of the slide member 31 is inserted and disposed in a groove 25*a* of the link 25, so as to be constantly engaged in the groove 25*a*. Namely, the link 25 is engaged with the slide member 31 via the pin 31*a*. Further, the link 25 is pivotally joined to the frame 22 by means of a hinge pin 25*b*. Accordingly, the slide member 31 is adapted to slide relative to the frame 22 in accordance with the swinging motion of the second swing arm 21. Namely, when the ottoman is in the retracted position, the links 25, 26 are located side by side as indicated by solid lines in FIG. 2, and the groove 25*a* at the distal end (the other end) of the link 25 brings the pin 31 to a position close to the pivot point of the second swing arm 21, so that the slide member 31 is placed in a retracted position. When the ottoman is in the lifted position, the links 25, 26 are positioned so as to extend generally straight as indicated by broken lines in FIG. 2, and the groove 25*a* at the distal end of the link 25 brings the pin 31*a* to a position remote from the pivot point of the second swing arm 21, so that the slide member 31 is placed in the deployed or extended position. Here, the links 25, 26 and the pin 31*a* constitute an interlocking mechanism of the invention.

In the following, the operation will be described. One of the motors is operated in accordance with the body height of the seated person, so as to swing the first swing arm 11 about the hinge shaft 42, and move the operating portion at the upper end of the first swing arm 11 back and forth within the bent portion of the surface portion 50, whereby the cushion length is changed. At this time, the second swing arm 21, frame 22, etc. of the ottoman body move along with the first swing arm 11. If the other motor is operated so as to operate or move the ottoman in the condition where the cushion length is adjusted, the motor operates, via the links 23, 24, to swing the second swing arm 21 about the hinge shaft 21*a* of the operating portion of the first swing arm 11, so that the ottoman is lifted. At this time, the slide guide 61 moves along with the second swing arm 21, and therefore, the distal end portion of the surface portion 50 is also lifted along with the second swing arm 21.

Figure 2:
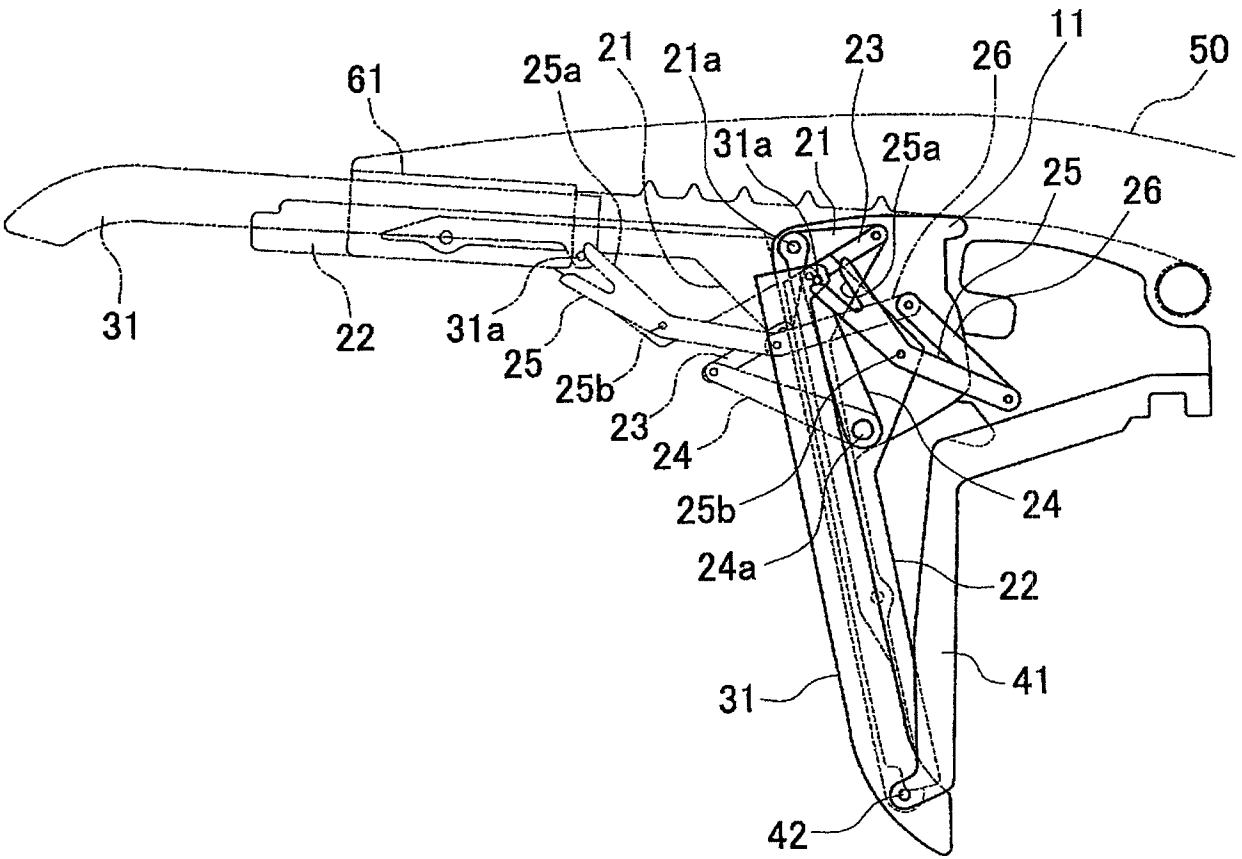
FIG. 2 is a side view useful for explaining an operating mechanism of the embodiment of FIG. 1, showing a condition in which an ottoman body is lifted.
Figure 3:
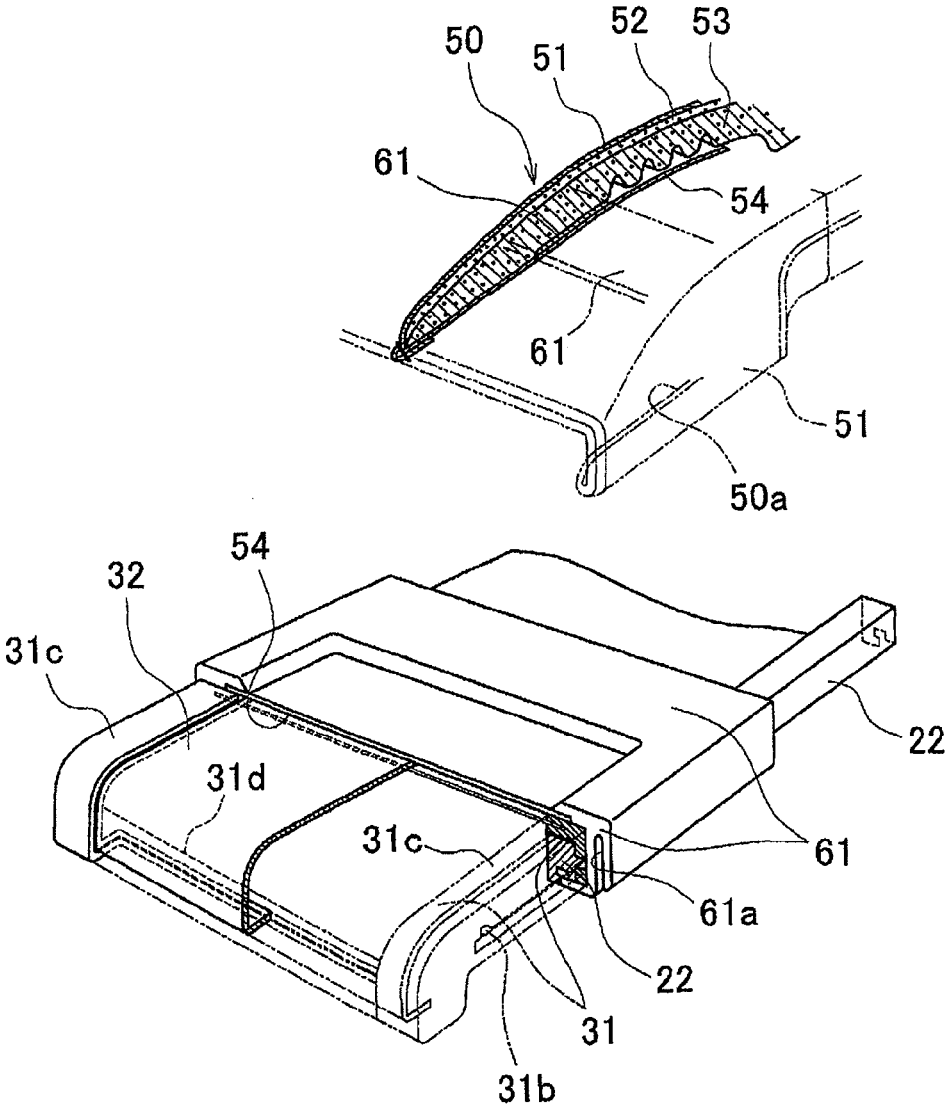
FIG. 3 is a partially cross-sectional, exploded perspective view useful for explaining a slide mechanism of the embodiment of FIG. 1.

Also, the frame 22 is swung along with the second swing arm 21, and the links 25, 26 are moved from the positions indicated by the solid lines in FIG. 2 to the positions indicated by the broken lines. During the movement of the link 25, the pin 31*a*, which is held in engagement with the groove 25*a* at the distal end of the link 25, is moved away from the pivot point of the ottoman, and the slide member 31 deploys forward. The angle by which the ottoman is lifted from the retracted position changes depending on the swing angle of each first swing arm 11, i.e., the cushion length. As the cushion length is larger, and the swing angle of the first swing arm 11 toward the front increases, the lift angle of the ottoman increases, so that the angle by which the two links 25, 26 are connected to each other becomes closer to 180°, and the amount by which the distal end of the link 25 pushes the slide member 31 forward increases. Namely, as the cushion length is larger, the length of forward deployment of the slide member 31 at the time of lifting of the ottoman increases, and the legs of the seated person are supported in accordance with the body size (the length of the below-knee region) of the seated person.

As described above, the ottoman body is provided as a unit with the operating portion of the cushion-length varying mechanism, and the cushion-length varying mechanism and the ottoman operating mechanism are able to operate independently of each other; therefore, the ottoman body is lifted at a given position where the cushion length is adjusted, and the cushion length can be adjusted according to the height of the seated person, while the ottoman main body can be lifted at a position corresponding to the height. Also, the length of the ottoman body when placed in the lifted position is adjusted according to the height of the seated person, so that the ottoman body can be lifted at such a position that causes the seated person to feel comfortable at his/her below-knee region.

The summary of the above-described embodiment will be described below.

The ottoman device according to this embodiment includes a cushion-length varying mechanism that has an operating portion operable to adjust a longitudinal position of a front end portion of a seat cushion corresponding to the inner sides of knees of a seated person, and is operable to vary the cushion length by adjusting the longitudinal position of the front end portion of the seat cushion by means of the operating portion, an ottoman body that extends from the front end portion of the seat cushion toward toes of the seated person, and an ottoman operating mechanism operable to lift the ottoman body by reducing a flexion angle of the ottoman body at the front end portion of the seat cushion, so as to bring the ottoman body into a lifted condition. In the ottoman device, the ottoman body is provided as a unit with the operating portion of the cushion-length varying mechanism, and the cushion-length varying mechanism and the ottoman operating mechanism operate independently of each other. With this arrangement, since the ottoman body is provided as a unit with the operating portion of the cushion-length varying mechanism, and both of the mechanisms can operate independently of each other, the ottoman body is lifted at a given position where the cushion length is adjusted, and the cushion length can be adjusted according to the height of the seated person, while the ottoman body can be lifted at a position corresponding to the height of the seated person.

In the ottoman device according to this embodiment, the length of the ottoman body that is in the lifted condition may be increased as the cushion length is increased. With this arrangement, the length of the ottoman body is adjusted according to the height of the seated person, and the ottoman body is lifted at a position where the seated person would feel comfortable at his/her below-knee region. Namely, where the angle of the ottoman when lifted, relative to the surface of the seat cushion, is the same irrespective of whether the cushion length is large or small, the length of the ottoman body is increased as the cushion length is increased.

In the ottoman device according to this embodiment, the cushion-length varying mechanism may include a first swing arm that swings in a longitudinal direction about a first hinge located in a lower portion of the cushion-length varying mechanism, and an upper end portion of the first swing arm functions as the operating portion. Also, the ottoman body may further include a second swing arm that is swung about a second hinge provided in the operating portion so as to lift the ottoman body, and is held in generally parallel with the first swing arm when the ottoman body is in a retracted condition in which the ottoman body is not lifted. With this arrangement, the adjustment of the cushion length according to the height of the seated person and the lifting of the ottoman main body at the position corresponding to the height can be accomplished with the simple arrangement.

The ottoman device according to this embodiment may further include a slide member that is slidably provided on the second swing arm, and an interlocking mechanism operable to change an amount of sliding of the slide member, based on a swing angle of the second swing arm when the ottoman body is in the lifted condition, relative to the first swing arm, such that the amount of sliding away from the second hinge of the second swing arm increases as the swing angle increases. With this arrangement, if the first swing arm is swung forward so as to increase the cushion length, and the swing angle of the second swing arm when the ottoman is lifted, relative to the first swing arm, increases, the amount of sliding of the slide member in the forward direction (i.e., away from the hinge center of the second swing arm) is increased by the interlocking mechanism. Thus, with the simple arrangement provided only with the slide member and the interlocking mechanism, the length over which the below-knee region of the seated person is supported by the ottoman body can be increased as the cushion length increases, and the ottoman body can be lifted at a position where the seated person would feel comfortable at his/her below-knee region, in accordance with the height of the seated person.

In the ottoman device according to this embodiment, the interlocking mechanism may include a first link having one end that is pivotally joined to the first swing arm, and a second link having one end that is pivotally joined to the other end of the first link, and the other end that is pivotally joined to the slide member.

In the ottoman device according to this embodiment, the other end of the second link may be located close to the second hinge when the ottoman body is placed in the retracted condition, and the other end of the second link may be located apart from the second hinge when the ottoman body is placed in the lifted condition.

In the ottoman device according to this embodiment, the first link and the second link may extend substantially straight when the ottoman body is placed in the lifted condition.

While the ottoman body is continuously covered with the surface portion of the seat cushion in the illustrated embodiment, the ottoman body and the surface portion of the seat cushion may be formed as separate bodies.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

What is claimed is:

1. An ottoman device for a variable-cushion-length seat, comprising:

a cushion-length varying mechanism that has an operating portion operable to adjust a longitudinal position of a front end portion of a seat cushion corresponding to inner sides of knees of a seated person, and is operable to vary a cushion length by adjusting the longitudinal position of the front end portion of the seat cushion by an actuation of the operating portion;

an ottoman body that extends from the front end portion of the seat cushion in a direction toward toes of the seated person; and an ottoman operating mechanism including a first link and a second link, the first link having a first end that is operably connected to a first end of the second link, and the second link having a second end that is operably connected to the ottoman body such that the ottoman operating mechanism is operable to lift the ottoman body by reducing a flexion angle of the ottoman body at the front end portion of the seat cushion, so as to bring the ottoman body into a lifted condition, wherein the ottoman body is provided as a unit with the operating portion of the cushion-length varying mechanism, and the cushion-length varying mechanism and the ottoman operating mechanism operate independently of each other.

2. The ottoman device according to claim 1, wherein the length of the ottoman body that is in the lifted condition is increased as the cushion length is increased.

3. The ottoman device according to claim 1, wherein the cushion-length varying mechanism includes a first swing arm that swings in a longitudinal direction about a first hinge located in a lower portion of the cushion-length varying mechanism, an upper end portion of the first swing arm functions as the operating portion, and the ottoman body includes a second swing arm that is swung about a second hinge provided in the operating portion so as to lift the ottoman body, said second swing arm being held in generally parallel with the first swing arm when the ottoman body is in a retracted condition in which the ottoman body is not lifted.

4. The ottoman device according to claim 3, wherein a slide member is slidably provided on the second swing arm, and an interlocking mechanism is operable to change an amount of sliding of the slide member, based on a swing angle of the second swing arm when the ottoman body is in the lifted condition, relative to the first swing arm, such that the amount of sliding away from the second hinge of the second swing arm increases as the swing angle increases.

5. The ottoman device according to claim 4, wherein the interlocking mechanism includes a first link having a first end that is pivotally joined to the first swing arm, and a second link having a fist end that is pivotally joined to a second end of the first link, and a second end that is pivotally joined to the slide member.

6. The ottoman device according to claim 5, wherein the second end of the second link is provided at a first position proximate to the second hinge when the ottoman body is placed in the retracted condition, and the second end of the second link is provided at a second position distanced from the second hinge when the ottoman body is placed in the lifted condition.

7. The ottoman device according to claim 6, wherein the first link and the second link extend substantially straight when the ottoman body is placed in the lifted condition.

* * * * *